US006209853B1

(12) United States Patent
Roy et al.

(10) Patent No.: US 6,209,853 B1
(45) Date of Patent: Apr. 3, 2001

(54) ELECTRIC WIRE INSULATOR AND SUPPORT BRACKET FOR METAL FENCE POSTS

(76) Inventors: Lewis Roy, 739 Speedway Rd., Roseburg, OR (US) 97470; Duane L. Roy, 5520 Monty La., Lolo, MT (US) 59847

( * ) Notice: Subject to any disclaimer, the term of this patent is extended or adjusted under 35 U.S.C. 154(b) by 0 days.

(21) Appl. No.: 09/217,597

(22) Filed: Dec. 21, 1998

Related U.S. Application Data

(60) Provisional application No. 60/068,437, filed on Dec. 22, 1997.

(51) Int. Cl.[7] ..... E04H 17/10

(52) U.S. Cl. ..... 256/10; 174/158 F

(58) Field of Search ..... 256/1, 10, 32, 256/47, 48, 50, 57; 174/161 F, 163 F, 158 F

(56) References Cited

U.S. PATENT DOCUMENTS

| | | | | |
|---|---|---|---|---|
| D. 216,672 | * | 3/1970 | Barnes . | |
| D. 299,022 | * | 12/1988 | King, Jr. et al. . | |
| D. 344,063 | | 2/1994 | Letarte et al. . | |
| 459,843 | | 9/1891 | Thomas . | |
| 486,463 | | 11/1892 | Greene . | |
| 1,654,534 | | 1/1928 | Dean . | |
| 1,673,613 | * | 6/1928 | Bach | 174/158 F |
| 1,693,670 | * | 12/1928 | Salesas . | |
| 1,839,239 | * | 1/1932 | Mahoney | 174/158 F |
| 2,429,857 | | 10/1947 | Verner | 174/161 |
| 2,445,009 | | 7/1948 | Strauss et al. | 174/45 |
| 3,370,834 | | 2/1968 | Reznicek . | |
| 3,464,671 | | 9/1969 | Thomas . | |
| 3,572,639 | | 3/1971 | Shettif . | |
| 3,652,780 | | 3/1972 | Wilson | 174/45 R |
| 3,759,490 | | 9/1973 | Berger . | |
| 3,820,758 | * | 6/1974 | Berg, Jr. et al. | 256/10 |
| 3,908,964 | | 9/1975 | Leiblich | 256/10 |
| 3,935,378 | | 1/1976 | Heyden . | |
| 4,023,307 | * | 5/1977 | Clark et al. | 256/47 X |
| 4,077,611 | * | 3/1978 | Wilson | 256/10 |
| 4,223,872 | | 9/1980 | Boal . | |
| 4,263,477 | | 4/1981 | Wilson, Sr. . | |
| 4,580,767 | | 4/1986 | Zimmerman . | |
| 4,695,677 | | 9/1987 | Ruth et al. . | |
| 4,862,637 | | 9/1989 | Dressel . | |
| 4,905,968 | | 3/1990 | Eby et al. | 256/10 |
| 4,982,932 | | 1/1991 | Baker . | |
| 5,085,409 | | 2/1992 | Teixeira | 256/48 |
| 5,255,896 | | 10/1993 | Letarte et al. . | |
| 5,809,734 | * | 7/1998 | Turner | 52/736.1 |
| 5,942,731 | * | 8/1999 | Rogerson | 174/163 R |
| 5,975,501 | * | 11/1999 | Berg et al. | 256/10 X |

* cited by examiner

*Primary Examiner*—Lynne H. Browne
*Assistant Examiner*—John R. Cottingham
(74) *Attorney, Agent, or Firm*—Dowrey & Associates

(57) ABSTRACT

An electric wire insulator and support bracket for metal fence posts having a cylindrical bracket arm slotted along its length to receive and be mounted on a flange of a steel fence post. Tie holes are located at each side of the slot for positioning a tie member for securing the bracket to the post. Wire retention slots are located in each end of the arm for supporting electric fence wires and retention pins confine the wires in the slots.

5 Claims, 7 Drawing Sheets

FIG. 10
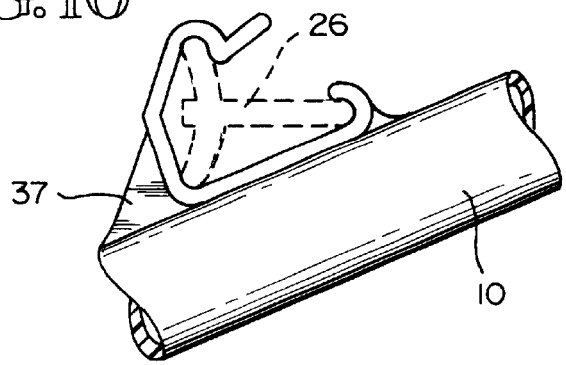
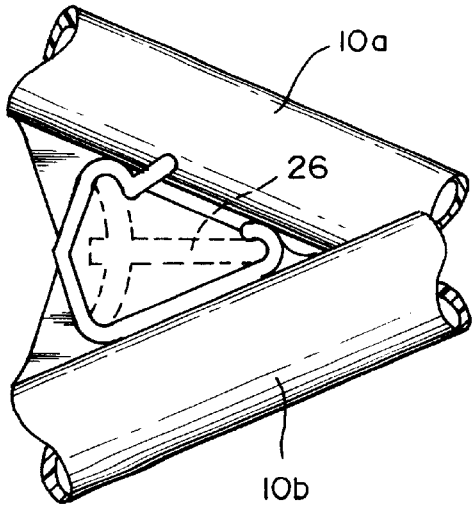
FIG. 11
FIG. 12
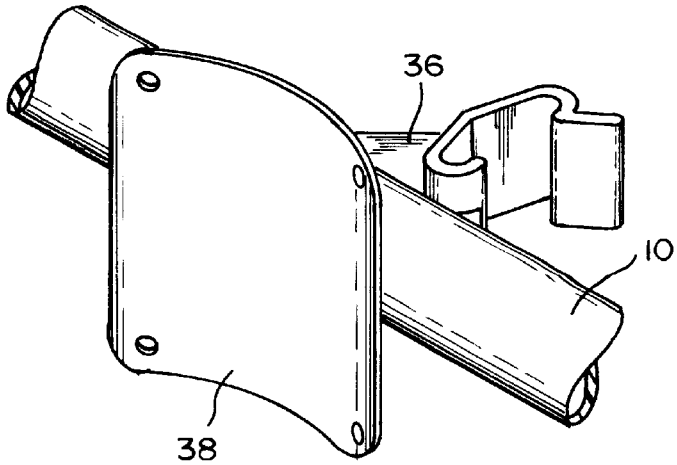

ELECTRIC WIRE INSULATOR AND SUPPORT BRACKET FOR METAL FENCE POSTS

This application claims benefit to U.S. Provisional application Ser. No. 60/068,437, filed Dec. 22, 1997.

BACKGROUND OF THE INVENTION

1. Field of the Invention

The present invention relates to a support bracket for attaching an electric fence wire to metal posts such as in garden, yard or field fencing. More specifically the bracket constitutes an electric insulator for supporting the electric wire spaced from the metal fence posts and cooperates with a flange on the metal fence posts for supporting the bracket and electrical wire.

2. Description of the Prior Art

It has become common practice in ranch, farm and orchard fencing to utilize some form of electrically charged wire to discourage and/or restrain livestock or game from access to certain areas or to protect vegetation. The electrically charged wire system may be utilized either as the sole barrier or, quite commonly, in combination with non-charged barriers such as field fencing. In most instances steel fence posts are the most economical means of fence support because of their indestructibility and because they are easily installed, removed and are reusable. The following are examples of insulator support brackets of various designs which have been utilized in conjunction with the steel fence posts to support electric wires.

| U.S. Pat. No. | Patentee |
|---|---|
| 2,429,857 | Verner |
| 2,445,009 | Strauss et al |
| 3,572,639 | Shettif |
| 3,652,780 | Wilson |
| 3,908,964 | Leiblich |
| 4,905,968 | Eby et al |
| 5,085,409 | Teixeira |

Most of these brackets are made of dielectric materials such as rubber or plastic with the bracket being attachable directly to the fence post or to some appendage attached to the post to provide support. Some problems encountered with prior art support brackets include the close proximity with which the electric wire is held to the steel post. The electrical system is subjected to arcing and grounding under severe field conditions such as the accumulation of debris or extremely wet or moist atmospheric conditions. Brackets made of lightweight plastics which "snap" on to the posts are especially vulnerable because of material fatigue and deterioration causing the brackets to dislodge from the post or to be broken by contact with animals. Other drawbacks such as the complexity and expense of an intricately designed bracket which may be either difficult to install and/or not reusable.

SUMMARY OF THE INVENTION

The electric fence wire post-mounting bracket arm of the present invention comprises an elongated arm fabricated from a non-conducting material such as plastic. In the preferred embodiment of the bracket arm, the bracket arm is fabricated as plastic tubular cylinder. The preferred embodiment of the bracket arm is designed for attachment to metal fence posts of a standard configuration such as a modified T-shaped cross-section (having two "wings" and "T-leg" segments as viewed in cross section). More broadly, the bracket arm is capable of being adapted for cooperation with any steel post configuration having longitudinally extending flanges such as commonly used steel angle iron posts. With the novel cooperation between the tubular support bracket and the metal post, a system of parallel wires running on both sides of the posts and/or field fence is made possible. The bracket arm comprises a simplistic structure which is adaptable for either single or double wire support and is versatile in its positioning on the flanges of the metal post and has the ability to cooperate with like brackets to form corner configurations at different angles.

Embodiments of the bracket arm may be designed for attachment to either a metal fence post or a wood fence post. The versatility of the bracket may be broadened by varying the hanger or attachment means, however, the configuration of the bracket arm for attaching and supporting electric fence wires may be the same.

BRIEF DESCRIPTION OF THE DRAWINGS

FIG. 10 is a top plan view of a segment of an alternate bracket arm fabricated with an integral metal fence post attachment clip, illustrating the bracket arm attached to a metal fence post so that the bracket arm is oriented askew to the fence line;

FIG. 11 is a top plan view of segments of two alternate bracket arms, each fabricated with an integral metal fence post attachment clip, illustrating the bracket arm attached to a metal fence post so that the two bracket arms are oriented askew to the fence line and at an acute angle to one another;

FIG. 12 is a perspective view of still another alternate bracket arm fabricated with an integral metal fence post attachment clip and with a concave wood post attachment plate.

DETAILED DESCRIPTION OF THE PREFERRED EMBODIMENT

Figure 1:
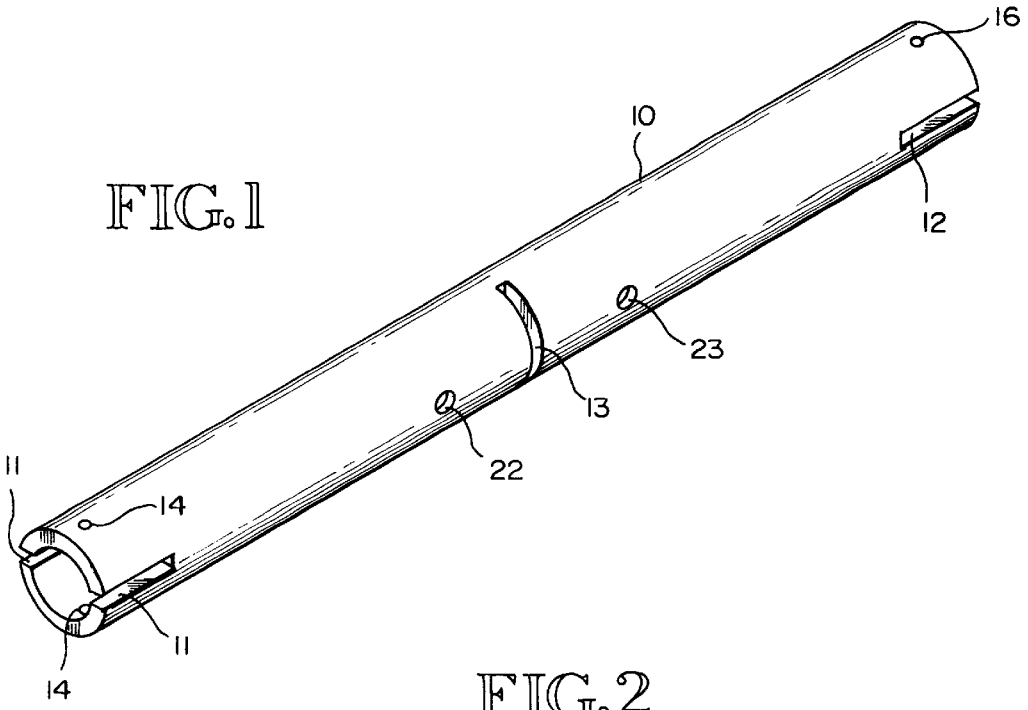
FIG. 1 is a perspective view of the insulator bracket arm of the invention.
Figure 2:
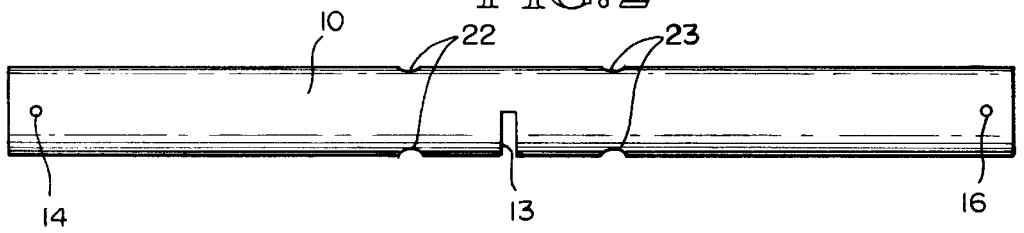
FIG. 2 is a top plan view of the bracket arm.
Figure 3:
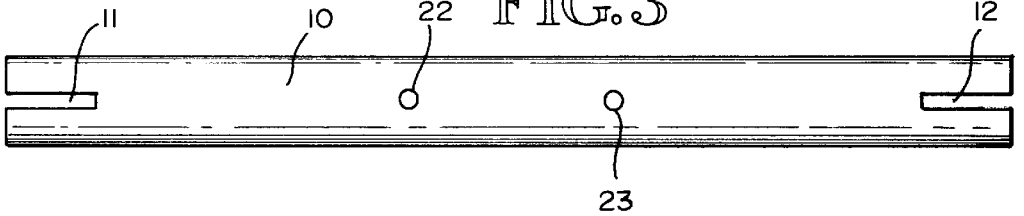
FIG. 3 is a side elevational view of the bracket arm.
Figure 4:
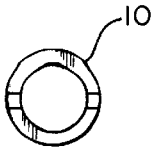
FIG. 4 is an end elevation of the bracket arm.
Figure 5:
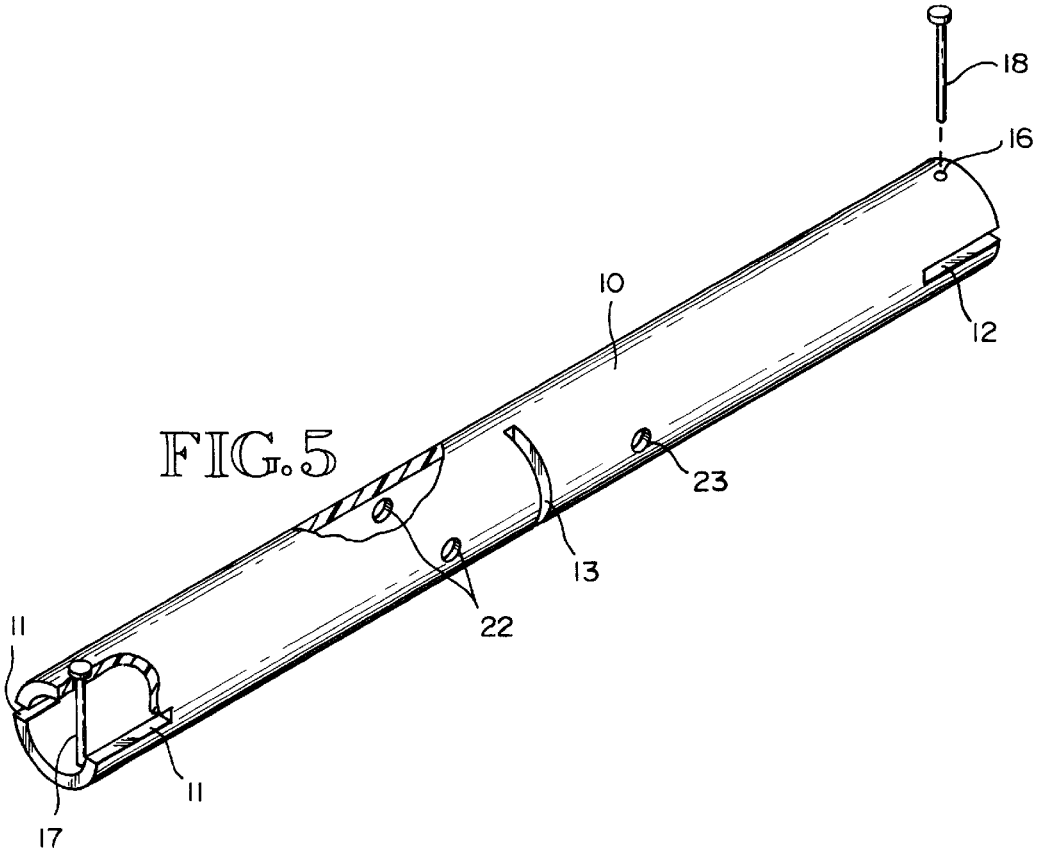
FIG. 5 is a partially sectioned perspective view of the bracket arm.

The bracket arm 10 shown in FIGS. 1–5 is a hollow plastic cylinder that may be injection molded or fabricated from PVC or other rigid plastic tubing. The cylinder is slotted at each end, with the slots 11 and 12 being diametrically located and coplaner along the central axes of the tube. The midpoint of cylinder 10 is slotted at right angles to its longitudinal axis to provide a metal fence post engaging slot 13. The slot 13 is perpendicular to the plane of the wire slots 11 and 12. Wire retaining holes 14 and 16 are provided at each cylinder end, perpendicular to and intersecting the wire slots 11 and 12, respectively for receiving pin retainers 17 and 18. The pin retainers are installed to retain electric fence wires 19 and 21 in place within the wire slots 11 and 12 respectively as shown in FIG. 6.

The mid-section of cylinder 10 is provided with longitudinally spaced wire-tie holes 22 and 23 located on opposite sides of the slot 13. The wire tie holes provide a mounting for a wire tie 24 which may be threaded through the holes 22–23 and around a metal fence post 26 to secure the flange of the post within the post slot 13 as shown in FIG. 6. The wire ties may be made from well known plastic locking strips or bands or from ordinary wire or any other suitable tieing material.

Figure 6:
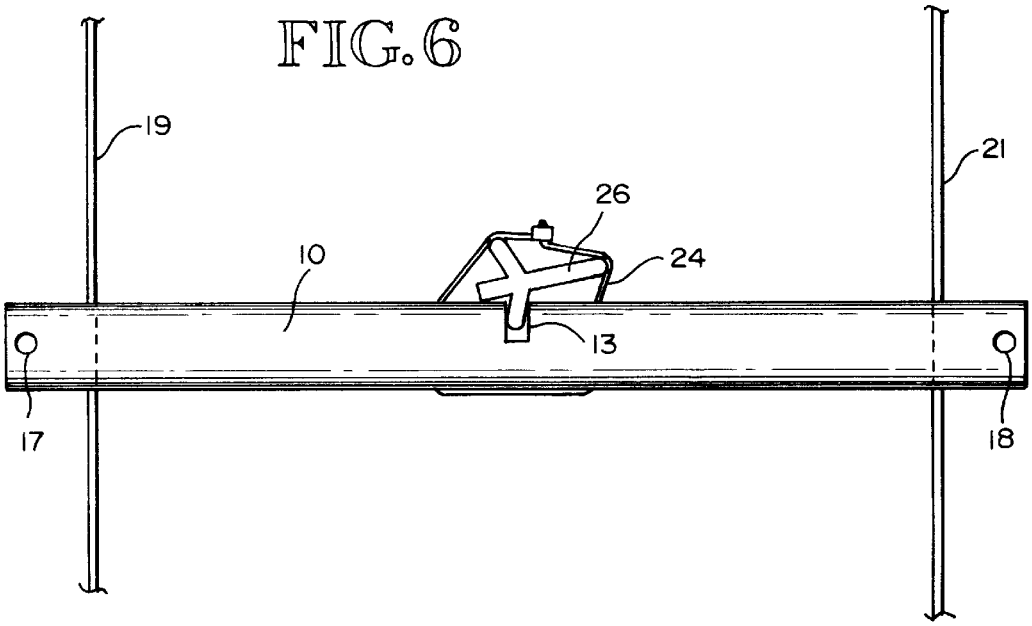
FIG. 6 is a top plan view of the FIG. 5 bracket arm as it would appear when attached to a metal fence line post and strung with two electric fence wires.
Figure 8:
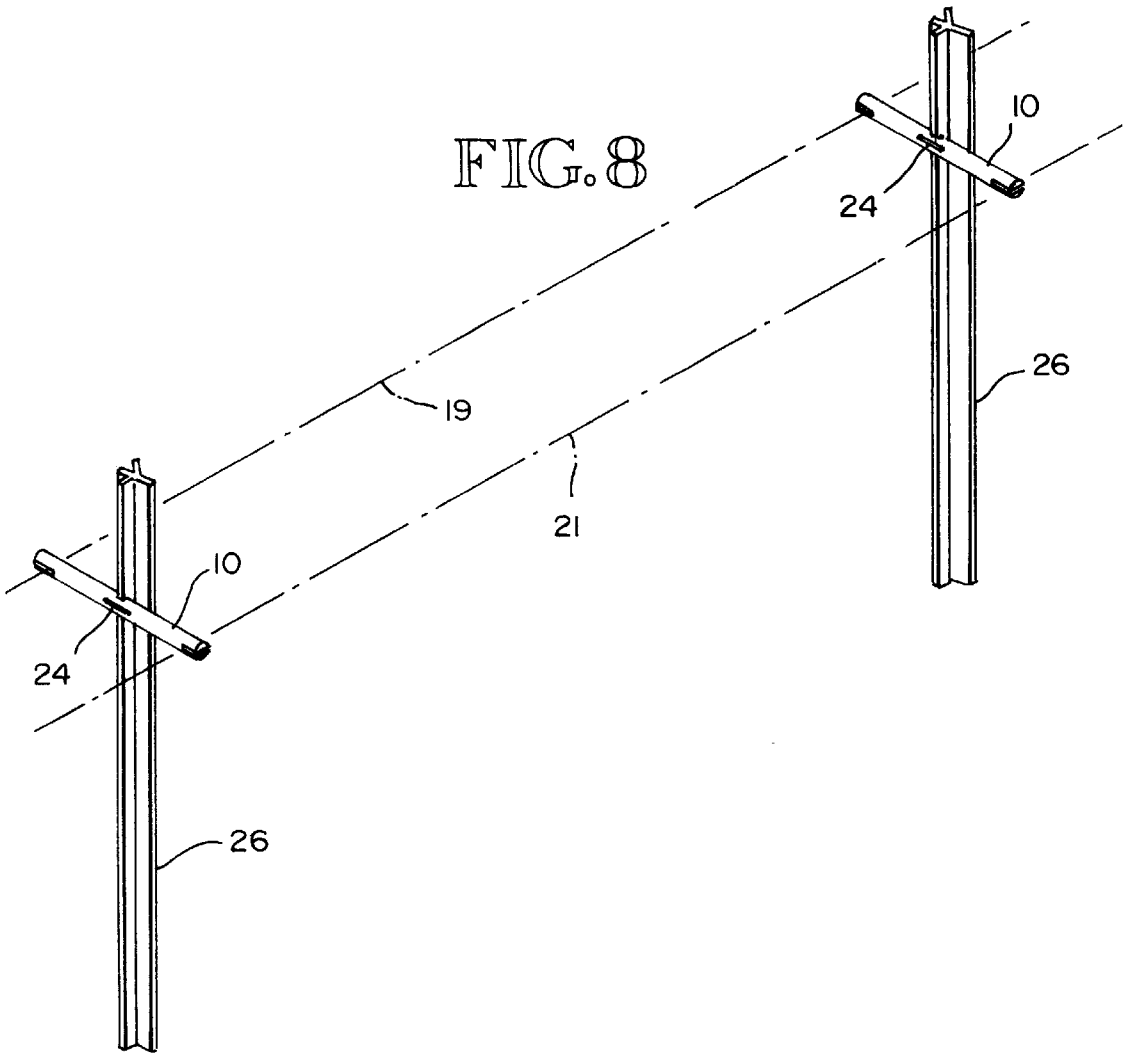
FIG. 8 is perspective view of the FIG. 6 brackets attached to metal fence line posts and strung with two electric fence wires.

FIG. 6 illustrates the cylinder 10 attached to a metal fence post 26 with the electric wires installed and FIG. 8 is a perspective illustration of a running fence line with two bracket arms installed. Each bracket arm is installed on a metal fence post 26, with two electric fence wires 19 and 21 being carried by the two bracket arms. When the bracket arm is installed on a fence post, the wire slots 11 and 12 provide horizontal passages to receive the fence wires. The retainer pin holes 14 and 16 are perpendicular to the slots for receiving the retainer pins 17 and 18 which may be retained by gravity. Alternately, the retainer pins 17 and 18 could be retained by screw threaded means, bent end portions, a friction fit with the retainer holes 14, 16 or any other convenient means.

The arrangement of the bracket arm cylinder 10 with end slots 11 and 12 enables the attachment of two electric fence line wires as shown in FIG. 6. The bracket arm has a length sufficient to space the two wires 19 and 21 at a desired distance apart. A typical cylinder length would be 12–18 inches for use with field fencing presently to be described or the bracket may be lengthened for use to protect plants, vines or bushes.

The cross-slot 13 for receiving the metal fence post web or cross-flange segment is wide enough so that the metal fence post 26 can be secured in place as shown in FIG. 6 by the wire-tie 24 extending through the holes 22 and 23. When secured in the position shown in FIG. 6, the bracket arm would extend slightly askew to the fence line unless the metal post was installed slightly askew as illustrated. In general, metal fence posts are seldom installed with their fence-engaging faces perfectly parallel to the fence line. Therefore, the orientation of the bracket arms with respect to the run of the fence line will be variable but more or less perpendicular to the fence line run. Although the illustrated embodiment depicts a conventional steel post having a web with a cross-flange forming a T-configuration, it will be understood that other post configurations which include longitudinal flanges or webs or an angle iron configuration will work equally well.

Figure 7:
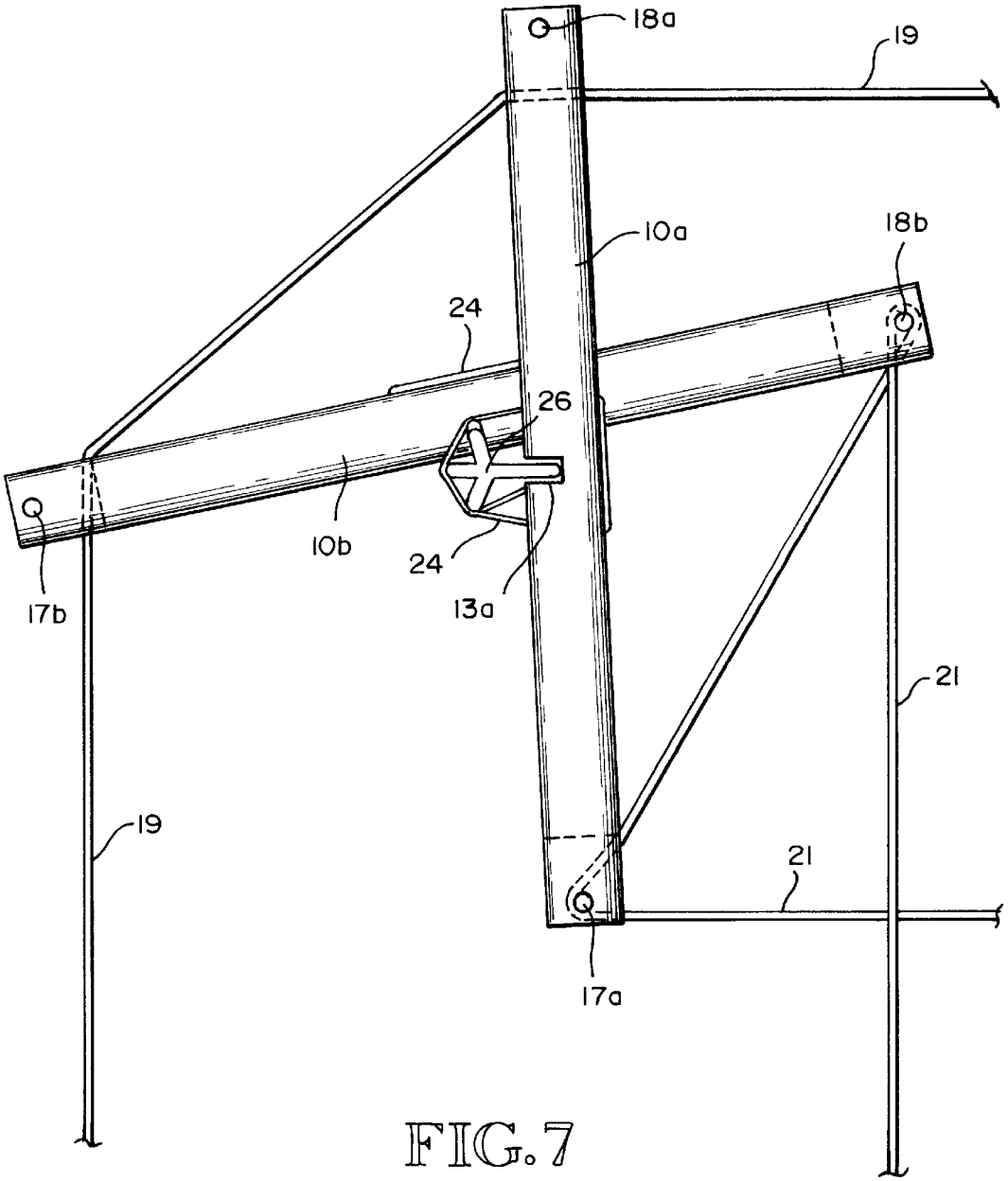
FIG. 7 is top plan view illustrating one method of forming a right angle corner in a double wire system.
Figure 13:
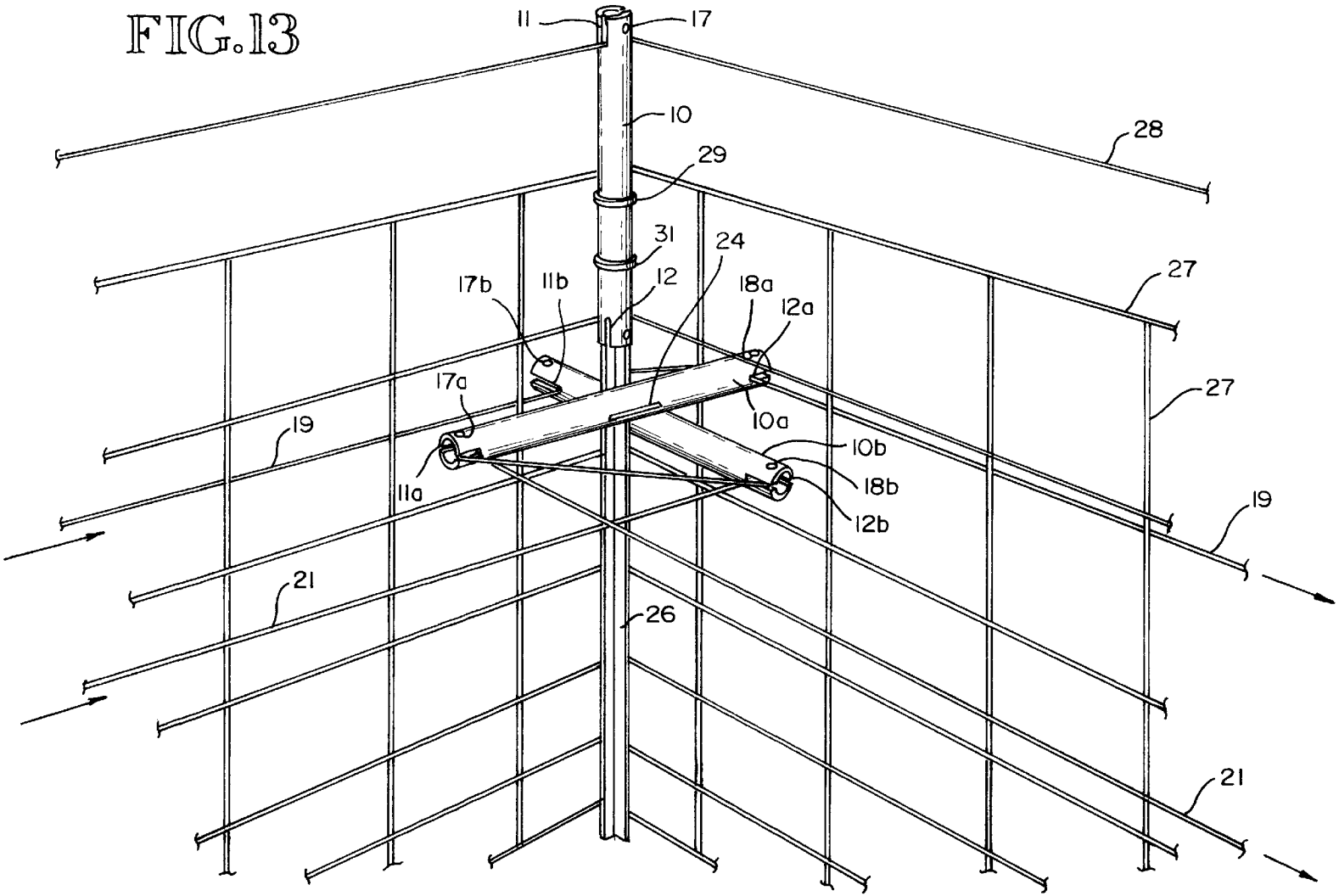
FIG. 13 is a perspective view illustrating a corner configuration for a double wire system of the type shown in FIG. 7 in combination with a standard field fence and the use of a vertically mounted bracket arm for carrying a single top wire.

FIGS. 7 and 13 illustrate an embodiment of a double wire system according to the present invention which may be utilized with ordinary field fencing 27. The insulator brackets may be used in this instance for keeping animals away from the fence, as for example where male and female animals are pastured on opposite sides of the fence. Although the present embodiment illustrates the double-wire runs of electrical wire at a particular level, it will be understood that, one or more such runs may be used at various levels, dependent upon the types of animals that are being restrained. FIGS. 7 and 13 in particular illustrate the arrangement wherein two bracket arms are utilized in combination to turn a right angle corner, with the two-wire system. The two bracket arms 10*a* and 10*b* will be initially attached to the corner post 26 with ties 24 in the manner previously described. The brackets 10*a* and 10*b* will be mounted one immediately on top of the other with the respective post engaging slots being fitted onto adjacent flanges of the steel post. As illustrated, the bottom bracket arm, in this case bracket 10*b*, will be located at either a right angle or askew to the direction of the incoming wires 19 and 21, i.e. wires coming into the corner in the direction of the arrows. The second bracket arm 10*a* will be likewise located at right angles or askew to the outgoing runs of the wires 19 and 21 as indicated by the arrows. The incoming outside wire 19 (i.e. on the outside of the fence 27) will pass through the slot 11*b* in the bracket 10*b* and from there will pass through the slot 12*a* in the bracket 10*a* and from thence along the outgoing outside run of the fence. The incoming run of the wire 21 on the inside of the fence will go first to the slot 12*b* and around the retainer pin 18*b* in the bracket 10*b*, from thenceback to the slot 11*a*, around the pin 17*a* and from thence along the outgoing run on the inside of the fence parallel to the electric wire 19. It will be understood, of course, that a plurality of such arrangements may be set up for any corner situation. Also, it would be possible to switch the order of the brackets 10*a* and 10*b* from upper to lower without affecting the operation.

In addition to the protection of the lower portion of the fence 27, the present bracket arm may be utilized to support a top electric wire such as the wire 28 shown in FIG. 13, spaced above the top level of the fence. Such an arrangement is valuable when restraining larger animals such as horses and cattle that have a tendency to break down the top wires of the fence. For this purpose, the tubular bracket arm 10 will be made with an inside diameter sufficient to accommodate the insertion of the top end of the fence post 26. In this position, as shown in FIG. 13, either of the end slots 11 or 12 may be utilized to contain the electric wire 28 with the cross pin 17 in place to ensure against removal of the wire. The tie holes 22 and 23 may be utilized to secure any form of tie members 29 and 31 to securely hold the bracket arm to the top end of the post.

Figure 7A:
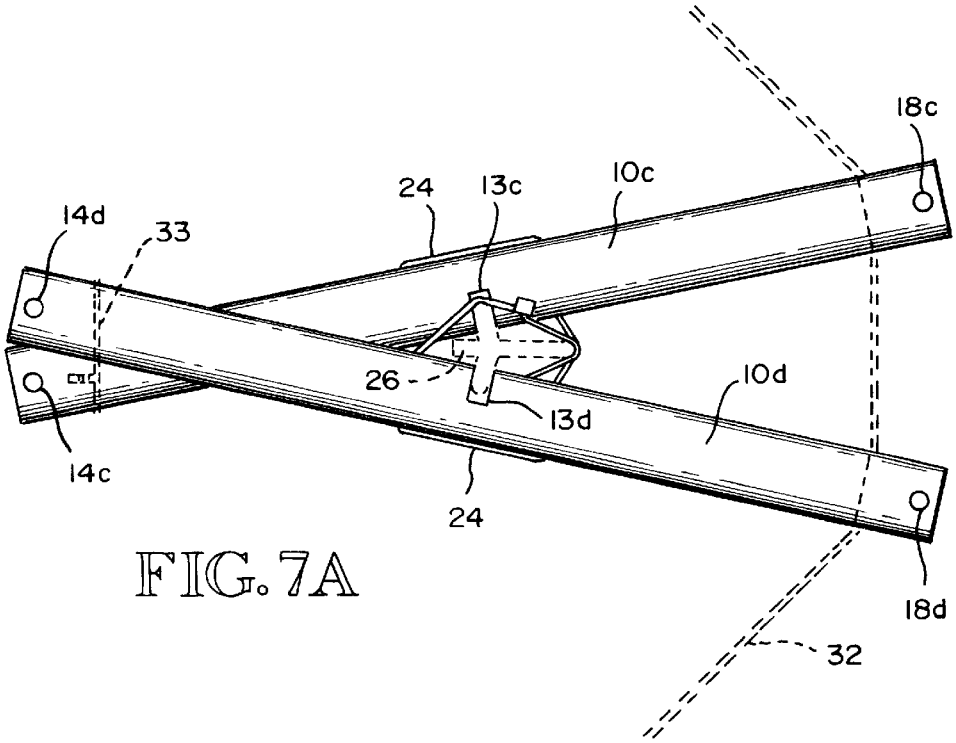
FIG. 7A is a top plan view illustration of the formation of an outside corner with a single wire system.
Figure 7B:
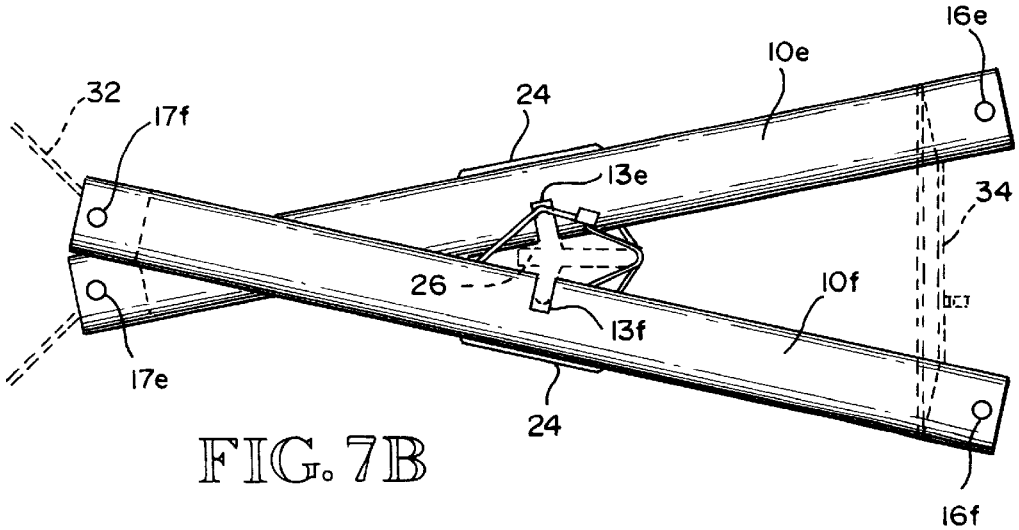
FIG. 7B is a top plan view showing the formation of an inside corner configuration utilizing a single wire system.

As shown in FIGS. 7A and 7B, two bracket arms may be installed on a single metal post 26 with one arm overlaying the other but in close proximity so that a single electric fence wire 32 may be strung through adjacent ends of the two bracket arms in order to form a corner. Each bracket arm may be attached to the post 26 by a wire tie, 24. The arrangements shown in FIGS. 7A and 7B illustrate the application of the bracket arms to form an outside and an inside corner respectively. In the FIG. 7A arrangement, the inside ends of the two bracket arms 10*c* and 10*d* may be tied together with a suitable wire tie 33 that extends through the respective wire slots and around the exteriors of the adjacent ends. In the FIG. 7B arrangement, the outside ends of the two bracket arms 10*e* and 10*f* may be tied together with a wire tie 34 that extends through the respective wire slots in the outside ends and around their exteriors. In the FIG. 7A arrangement, retainer pins 18*c* and 18*d* are installed in the retainer holes to retain the fence wire 32 in place. In the FIG. 7B arrangement, retainer pins 17*e* and 17*f* would be installed in the retainer holes to retain the fence wire 32 in place.

Figure 9:
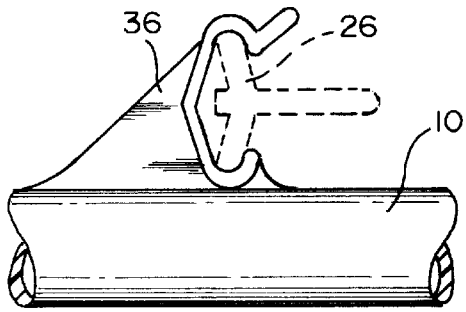
FIG. 9 is a top plan view of a segment of an alternate bracket arm fabricated with an integral metal fence post attachment clip, illustrating the bracket arm attached to a metal fence post so that the bracket arm is oriented perpendicularly to the fence line.

As an alternative to using a slotted bracket arm with a wire tie to hold the bracket arm to the fence post, the bracket arm cylinder 10 may be fabricated with an integral metal fence post clip 36, as shown in FIG. 9. It will be understood, of course, that the additional support and rigidity provided by the slotted engagement will be sacrificed. In FIG. 9 the post clip 36 is configured to be attached across the wire-engaging face of the metal fence post 26 by engaging the two wings of the post as shown. In FIG. 10 the post clip 37 is configured to be attached across the side of the metal fence post 26 by engaging one wing and the T-leg of the post as shown. The FIG. 10 arrangement of the post clip 37 would be particularly useful for attaching two bracket arms 10*g*, 10*h* to the metal fence post 26 as shown in FIG. 11 when the metal post is a corner post.

As still another alternate to the use of a slotted bracket arm and wire tie to attached the bracket to a fence post, the cylinder 10 may be provided with both an integral metal fence post clip and a concave plate for attachment to a wood post. FIG. 12 illustrates this embodiment wherein metal fence post clip 36 of the FIG. 9 embodiment is depicted, although clip 37 of the FIG. 10 embodiment could be used instead. FIG. 12 also illustrates an integral concave plate 38 for attachment to a cylindrical wood post. Plate 38 could easily be fabricated to provide a right angle for instance, rather than an arcuate configuration for attachment to a rectangular cross sectional wood post. FIG. 12 also depicts a solid cylinder or rod, rather than a tubular cylinder.

It is to be understood that the foregoing description and accompanying drawings have been given by way of illustration and example. It is also to be understood that changes in form of the several parts, substitution of equivalent elements and arrangement of parts which will be readily apparent to one skilled in the art, are contemplated as within the scope of the present invention, which is limited only by the claims which follow.

What is claimed is:

1. An electric wire insulator bracket comprising;

an elongated cylindrical tubular shaft bracket body having terminal ends and a dielectric portion on each terminal end thereof;

an attachment structure located along the length of said body for receiving a side of a vertical member, said vertical member comprising a metal post having at least one longitudinally extending flange on the surface thereof, said attachment structure attaching the body to the metal post in a fixed position of rotation about the longitudinal axis of the post with the terminal ends thereof located on opposite sides of the vertical post for retaining an electrically charged wire on both sides of said post, said attachment structure comprising a mounting slot of substantial depth in the mid portion of said body extending at right angles to the longitudinal axis of the body, said mounting slot being sized to provide a snug fit over the flange on said post, a tie hole located on each side of said mounting slot and extending through the bracket body, a tie member extending through said tie holes and around said metal post to secure the bracket body to the post in a generally horizontal plane, a wire retention structure on each said dielectric terminal end portions comprising a cross slot on the end face of the body for receiving and retaining an electrically charged wire and holding it out of contact with said post, said cross slots being oriented in a generally horizontal plane when said body is in the fixed position, and pin retention members in said body intersecting said cross slots to retain said wires in the associated cross slots.

2. The insulator bracket of claim 1 wherein said bracket body comprises a hollow cylindrical member composed of a dielectric material.

3. In an electric wire fencing system comprising vertical metal posts including a corner post having multiple angularly disposed longitudinal flanges and parallel electrically charged wires located on both sides of said posts, one said wires comprising an inside wire and the other comprising an outside wire, said wires having an incoming run toward said corner post and an outgoing run away from the corner post, a wire support system for changing the direction of both said wires about said corner post comprising;

first and second elongated insulator brackets adapted to support an electrically charged wire on each terminal end thereof, each said bracket including a mounting slot sized to provide a snug fit over a flange on said post to hold said bracket at right angles to said post and a tying member to secure the bracket to the post, said first bracket being mounted on a post flange and oriented parallel to the direction of said incoming wire runs, said second bracket being mounted on an adjacent post flange immediately vertically adjacent said first bracket and oriented askew thereto in the general direction of said outgoing wire runs, the incoming run of said outside wire being supported by the outside end of said second bracket and to the outside end of said first bracket to form the outside wire of the outgoing run, and the incoming run of said inside wire being supported by the inside end of said second bracket and extending thence to the inside end of said first bracket to form the inside wire of the outgoing run parallel to the outgoing run of the outside wire.

4. In an electric wire fencing system comprising vertical metal posts having multiple angularly disposed longitudinal flanges and an electrically charged wire located on one side of said posts comprising an inside wire, said wire having an incoming run toward a corner post and an outgoing run away from the corner post, a wire support system for changing direction of said wire at the inside of said corner post comprising;

first and second elongated insulator brackets adapted to support an electrically charged wire on the terminal ends thereof, each said bracket including a mounting slot sized to provide a snug fit over a flange on said post to hold said bracket at right angles to said post and a tieing member to secure the bracket to the post, said first and second brackets being mounted vertically adjacent on adjacent post flanges such that converging ends are located on the inside of the corner post and diverging ends are located on the outside of the corner post, said wire being connected to the converging ends of the brackets to form a transition between the incoming and outgoing runs, and tie means connected between the diverging ends of the brackets to assist in holding the brackets against the post.

5. The electric fencing system according to claim 4 wherein;

said electrically charged wire comprises an outside wire, and said wire being connected to the diverging ends of the brackets to form a transition between the incoming and outgoing runs, and said tie means is connected between the converging ends of the brackets to assist in holding the brackets against the post.

* * * * *